United States Patent [19]

Gratzmuller

[11] 4,034,175

[45] July 5, 1977

[54] PROTRACTED-BLAST ELECTRIC CIRCUIT-BREAKER FOR ALTERNATING CURRENTS

[76] Inventor: Jean Louis Gratzmuller, 66, Boulevard Maurice Barres, Neuilly-sur-Seine, France, 92200

[22] Filed: Aug. 18, 1975

[21] Appl. No.: 605,428

[30] Foreign Application Priority Data

Aug. 27, 1974 France ..... 74.29200
July 11, 1975 France ..... 75.21809

[52] U.S. Cl. ..... 200/150 R; 200/150 B
[51] Int. Cl.[2] ..... H01H 33/68
[58] Field of Search ..... 200/150, 150 B, 150 G, 200/148 G

[56] References Cited

UNITED STATES PATENTS 3,002,073 9/1961 Cobine ..... 200/150 B
3,842,227 10/1974 Gratzmuller ..... 200/150 R

*Primary Examiner*—Robert S. Macon

[57] ABSTRACT

An electric circuit-breaker in which the arc extinction chamber is filled with liquefield SF6 under pressure.

The moving contact of the circuit-breaker cooperates with a blast-piston which, during opening of the breaker and after the moving contact has reached its ultimate open position, continues its travel in order to produce an intensive and protracted circulation of liquid dielectric from the arc extinction chamber in the region where the arc strikes across the contacts.

Applications to ultra-high-speed breaking of high-tension, high-intensity alternating currents.

10 Claims, 6 Drawing Figures

FIG.3
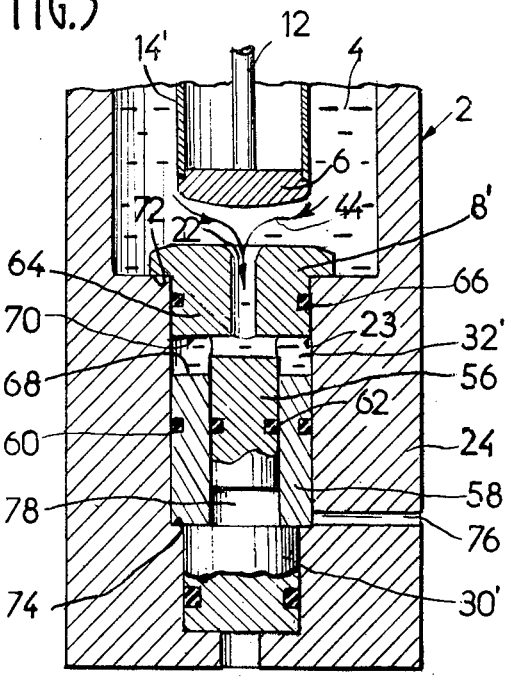
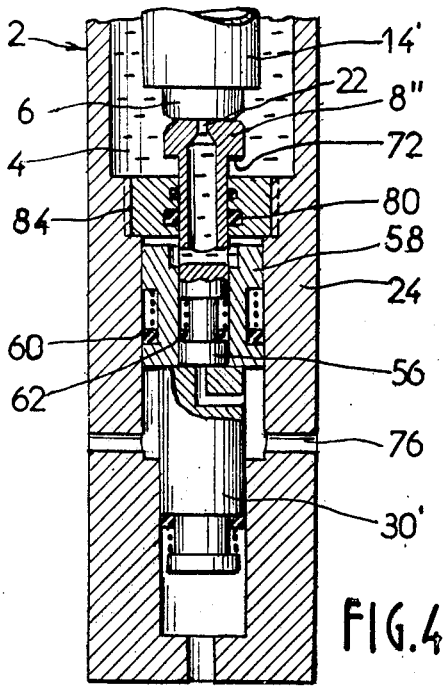
FIG.4
FIG. 5
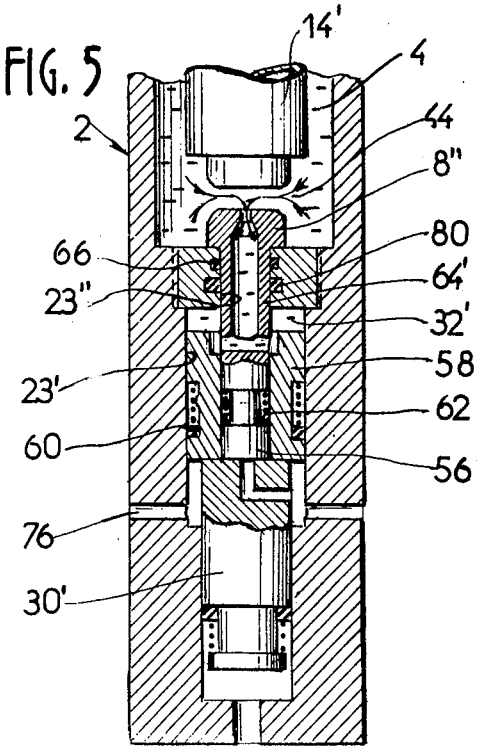
FIG.6
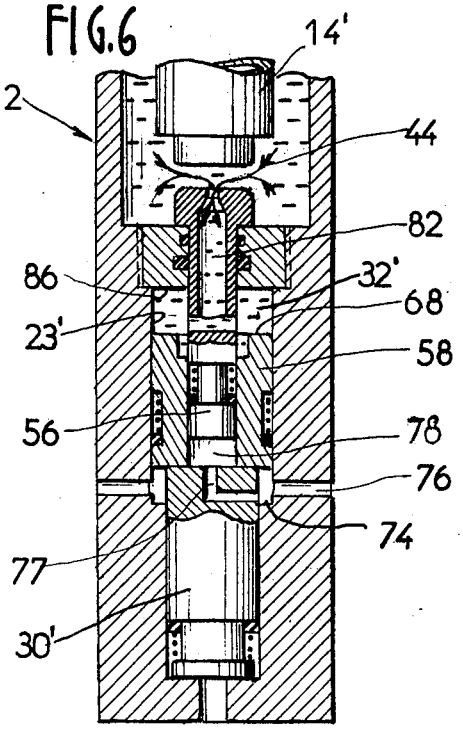

PROTRACTED-BLAST ELECTRIC CIRCUIT-BREAKER FOR ALTERNATING CURRENTS

The present invention relates to electric circuit-breakers in which the arc extinction chamber enclosing the fixed and moving contacts that determine opening or closure of the breaker if filled with a dielectric fluid consisting of a liquefiable dielectric gas which is maintained in the liquid state permanently at an appropriate substantially constant pressure.

By way of dielectric fluid, one can use preferably liquefied sulphur hexafluoride (SF6) in such circuit-breakers.

Among circuit-breakers of this kind, the invention concerns more particularly those in which the moving contact, responsively to thrust-exerting actuating means, bears under pressure against the fixed contact when the circuit-breaker is in the closed position, and in which the moving contact is formed with an axial passage therethrough forming a liquid dielectric blast nozzle having port adjacent to and between the contacters. In such circuit-breakers, blowing out of the arc as such contacts open is produced by an intensive centripetally directed circulation of liquid dielectric from the arc extinction chamber.

Circuit-breakers of this type, hereinafter designated "circuit-breakers of the aforementioned type", have been notably described in French Pat. No. 1 430 333 (filed Jan. 21, 1965), No. 1 537 673 (filed Apr. 15, 1966) and No. 71 35 197 (filed Sept. 30, 1971).

This invention has for its object to achieve improved blowing out of the arc in circuit-breakers of the aforementioned type and, more specifically, a blast of protracted duration for breaking alternating currents.

In the above-cited patents, the blast system operates only while the moving contact is separating, and this separation time is extremely short in this type of circuit-breaker (about 1 to 3 milliseconds for example), owing to the fact that the gap between the contacts in their open position can be very small (for example of the order of 10 mm for a voltage of 200 kilovolts) because of the dielectric qualities of SF6 in the liquefied state. Such blast systems are well-suited to direct current type circuit-breakers.

However, for breaking alternating currents at industrial or even higher frequencies for instance, the arc can be extinguished only after a zero-passage, that is to say that the blast must be prolonged after the moving contact has reached its ultimate open position to ensure definite extinction of the arc.

The present invention provides for an ultra-high-speed circuit-breaker, but in which the blast process is protracted long enough to extinguish the alternating-current arc and to cool the contacts and completely de-ionize the dielectric fluid.

The invention relates to a circuit-breaker of the aforementioned type, characterized in that the moving contact is carried by a first piston cooperating with a second coaxial piston, or blast piston, the said two pistons sliding one within the other and the assembly formed by said coaxial pistons sliding through a bore formed through the end of the extinction chamber; in that each of the pistons has one face in contact with the dielectric under pressure contained in the extinction chamber; in that said assembly is controlled by said actuating means; and in that stop means limit the travel of the first piston to a value less than the travel of the second piston, whereby the blast process is protracted beyond the instant when the moving contact carried by the first piston has reached its position of maximum distance from the fixed contact.

In one form of embodiment of the invention, the first piston carrying the moving contact is an annular piston formed by a hollow cylinder sliding through said bore; the second piston is a solid piston slidably supported within the first piston, said second piston bounding between one of its faces and the facing side of the moving contact an auxiliary variable-volume chamber, or blast chamber, communicating via said passage with the arc extinction chamber, and said actuating means acting on said second piston.

By virtue of this arrangement, the actuating means (the rod of a hydraulic actuator for example) are disconnected from the moving contact during part of their travel, that is to say that, upon opening of the circuit-breaker and after the moving contact has reached its final spaced position, the blast piston can move through the blast cylinder so as to increase the volume of the auxiliary chamber and thereby generate in the blast nozzle, for a sufficient time, an intensive circulation of liquid dielectric from the arc extinction chamber. During closure of the contacts, the actuating means are likewise disconnected from the moving contact for part of their travel, as will be explained hereinafter.

In an alternative form of embodiment, the two coaxial pistons are inversely arranged mutually. This new arrangement permits not only of protracting the blast process after the moving contact has reached its maximum spaced position but also, in accordance with a preferred embodiment, of initiating the blast as soon as the moving contact begins to move away from the fixed contact.

In accordance with this embodiment, the second piston, or blast piston, is an annular piston through which slides the first piston fast with the moving contact. It is possible with this arrangement to provide a variable-volume blast chamber the volume of which begins to change as soon as the assembly formed by the two pistons and the moving contact begins its contacts-spacing motion.

The present invention applies alike to circuit-breakers in which the moving-contact opening motion is produced positively by the said actuating means, to those in which tripping spring means permanently available (in the form, say, of pneumatic spring means) tend to move away the moving contact when said actuating means are released, and to those in which such tripping spring means are provided solely by the volumetric elasticity of the dielectric SF6 in the liquid state which is contained in the extinction chamber and tends to thrust away the moving contact (as was described in detail in the third of the above-cited patents).

The description which follows with reference to the accompanying non-limitative exemplary drawings will give a clear understanding of how the invention can be carried into practice.

In the drawings:

FIG. 3 is a fragmental sectional view of the circuit-breaker in the tripped position; and FIGS. 4, 5 and 6 illustrate an alternative embodiment of the invention in the switched-in position, in the course of tripping and in the tripped position, respectively.

Figure 1:
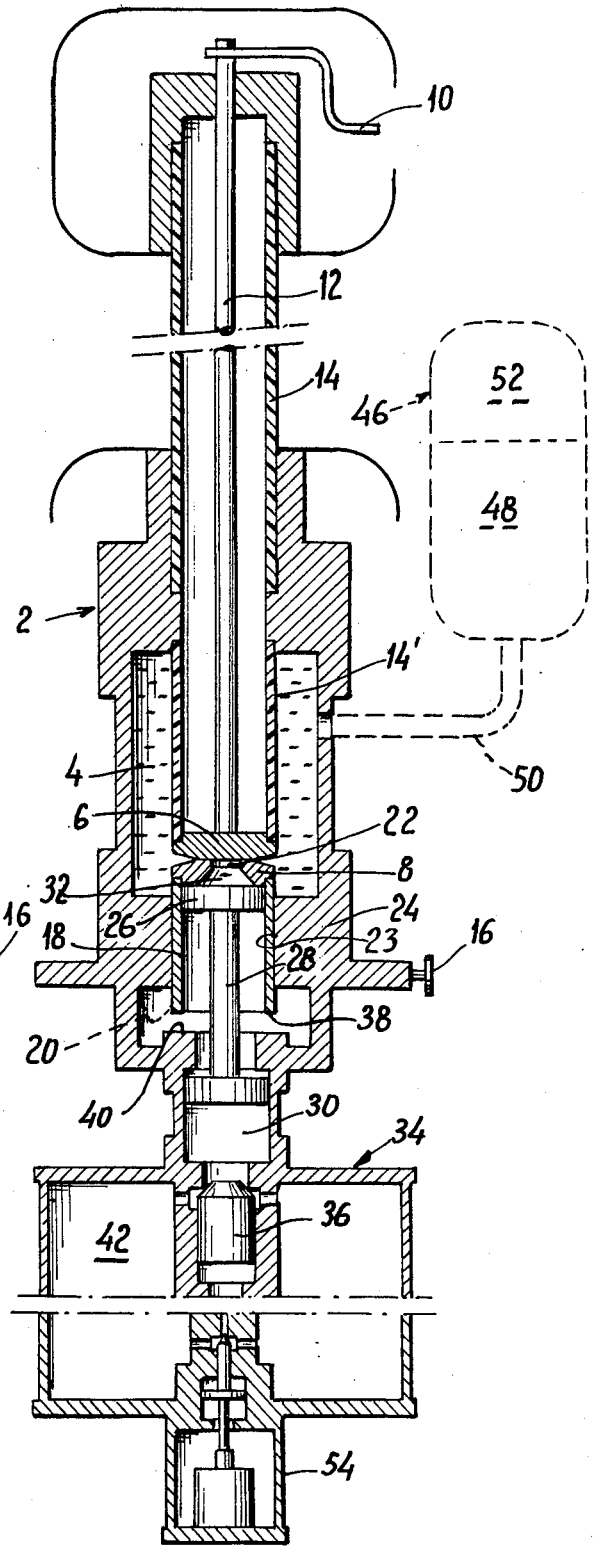
FIG. 1 is a sectional view of a circuit-breaker according to the invention in the switched-in position, that is, with the contacts closed.

Referring first to FIG. 1, the circuit-breaker shown thereon includes a preferably metallic main body 2 having an arc extinction chamber 4 formed therein. Chamber 4 contains a fixed contact 6 and a moving contact 8. Fixed contact 6 is connected to one of the circuit-breaker terminals 10 by an electrically conducting bar 12 surrounded by insulating tubes 14–14'. Moving contact 8 is electrically connected to the other circuit-breaker terminal 16 by a sliding cylinder 18 and a metallic braid 20, as will be explained in greater detail hereinbelow.

Arc extinction chamber 4 is filled with liquefied SF6 maintained permanently at a pressure substantially higher than the critical pressure (36.8 atmospheres for SF6), say from two to ten times higher than this pressure, by pressurizing means (not shown) described in the aforecited patents.

It is proposed first to describe the preferred embodiment of the invention, in which use is made of the volumetric elasticity of the liquefied SF6 to cause tripping of the circuit-breaker; that is to say that, in this case, the pressure of the dielectric may be in the region of 200 to 400 bars.

Moving contact 8 has an axial passage 22 formed therethrough and is fixed to a hollow metallic cylinder 18, which cylinder is fluidtightly slidable through a bore 23 formed in the end-face 24 of circuit-breaker body 2.

Slidable through cylinder 18, likewise fluidtightly, is a piston 26 controlled by actuating means consisting, in this particular embodiment, of the rod 28 of a hydraulic actuator 30.

When the circuit-breaker is in the switched-in position (FIG. 1) moving contact 8 is in pressure contact against fixed contact 6, the thrusting pressure being provided by the hydraulic actuating pressure prevailing in actuator 30, which pressure is transmitted to the moving contact through the actuator rod 28 operating in the thrust mode, and by the blast piston 26 which, in this position, bears against the lower face of moving contact 8. As a result, moving contact 8 is pressed against fixed contact 6 against the countering volumetric elasticity of the liquid SF6 contained in extinction chamber 4, which elasticity urges the moving contact out of the extinction chamber.

The upper face of blast piston 26 and the lower face of moving contact 8 jointly bound an auxiliary chamber or blast chamber 32 which communicates with extinction chamber 4 only through the axial passage 22 formed in the moving contact.

Figure 2:
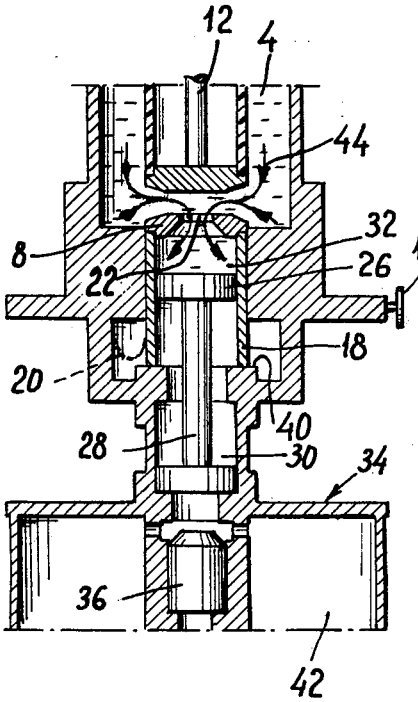
FIG. 2 is a fragmental sectional view of the same circuit-breaker in the tripped position (contacts open)

With the hydraulic control system 34 shown by way of example in FIGS. 1 and 2, tripping of the circuit-breaker is obtained by setting the hydraulic actuator 30 in the drain configuration by causing drain valve 36 to open (which valve is shown in the open position in FIG. 2).

As soon as the volume of oil contained in actuator 30 has been decompressed, the thrusting pressure against the moving contact vanishes, and accordingly the assembly consisting of moving contact 8, cylinder 18 and piston 26 moves bodily in response to the pressure of the liquid SF6 exerted on the annular surface of the moving contact and on the upper face of blast piston 26.

The moving contact therefore recedes from the fixed contact up to its ultimate spaced position, which position is set by any convenient abutment device such as through abutment of the lower edge 38 of cylinder 18 against a stop surface 40 provided at the bottom of body 2, as shown in FIG. 2.

During this initial phase of the tripping operation, the liquefied SF6, by virtue of its volumetric elasticity, fills the interval between the two contacts and substantially centres the arc over the axis of the contacts.

As the pressure of the SF6 continues to be exerted against the upper face of piston 26, the latter continues to be thrust downwardly and, through the agency of rod 28, thrusts away the piston of actuator 30 which accordingly continues to drain through open valve 36 into a low-pressure reservoir 42.

During this second phase of the tripping operation, piston 26 is thus disconnected from moving contact 8 and from blast cylinder 18, whereby the volume of blast chamber 32 increases and an intensive centripetal circulation of liquid dielectric is established in the direction of arrows 44 (FIG. 2), between extinction chamber 4 and blast chamber 32. Together with the axial passage 22, the facing surfaces of the two contacts form a nozzle-shaped passage through which the dielectric liquid is guided in order to subject the arc to strong turbulence and energetic blasting. In this way the blasting can be prolonged for a sufficient time after final separation of the contacts to extinguish the arc at the next zero-passage.

The various component parts can be so devised as to cause the second phase of the operation (blasting) to be protracted for as long as, say, three to six times the duration of the initial phase of the operation (separation of the contacts).

To reclose the circuit-breaker, the hydraulic actuating pressure is applied to actuator 30 by means well-known per se (not shown) after closure of drain valve 36, so as to raise blast piston 26 against the lower face of the moving contact and apply the latter against the fixed contact once more, this closing operation being effected against the countering volumetric elasticity of the liquid SF6 contained in arc extinction chamber 4.

In the operating mode just described, only the volumetric elasticity of the liquid SF6 provides the tripping spring means. In an alternative embodiment, shown in dash-lines in FIG. 1, recourse may be had to a hydraulic accumulator 46 such as a hydro-pneumatic accumulator, of which one portion 48 which communicates with extinction chamber 4 through a heavy-section pipe 50 is filled with liquid SF6, while the other portion 52 is filled with a gas under pressure, such as nitrogen or helium.

In a circuit-breaker according to this invention, the hydraulic actuating means may be of any convenient type provided that it is of the fast response kind. The actuating system 34 shown partially in FIG. 1 is of the type described in French Pat. No. 74 10 294 filed Mar. 26, 1974.

It will suffice to state that this actuating system basically includes a fast-acting electrically operated drain valve of small section 54 that controls opening of a succession of drain valves of increasing section, the last one of which is the drain valve 36 of actuator 30.

In the embodiment illustrated in FIG. 3, moving contact 8' formed with its axial passage 22 is supported by a first piston 56 sliding through a second piston, or blast piston 58. Thus the blast piston is in this case an annular piston which, by virtue of a seal 60, slides leaktightly through the bore 23 formed in the end-face 24 of the circuit-breaker extinction chamber 2. Leaktightness between piston 56 and annular piston 58 is ensured by a seal 62.

The base 64 of moving contact 8' also slides through bore 23, with a seal 66 merely providing relative leaktightness upon passage of the base of the moving contact into the bore. Jointly with the facing annular surface 70 of the base of the moving contact, the annular surface 68 of blast piston 58 bounds within bore 23 a variable-volume auxiliary chamber or blast chamber 32' which communicates with extinction chamber 4 through the passage 22.

On the moving contact, abutment means such as a flange 72 limit the travel of the moving contact to less than the stroke of blast piston 58, which stroke is limited for example by a stop 74.

The circuit-breaker actuating means, such as a hydraulic actuator 30', operate to exert joint pressure on the two pistons 56 and 58.

The manner of operation will now be described in greater detail with reference to the embodiment of FIGS. 4, 5 and 6, and it will suffice to indicate that, in the switched-in position, chamber 32' is at its minimum volume. When the pressure in actuator 30' is released, the pressure of the dielectric thrusts the two-piston assembly 56 and 58 until contact 8' reaches the end of its travel; thereafter, in the course of a second phase, annular blast piston 58 continues its travel alone, thereby increasing the volume of chamber 32' and causing an intensive centripetal circulation of the blasting dielectric in the direction of arrow 44. The blasting is thus prolonged until blast piston 58 reaches its stop 74.

A vent pipe 76 prevents the space 78 formed between the pistons when tripping occurs from being set under negative pressure. Rubbing contacts or a flexible braid (not shown) provide a path for the current from the moving contact up to the end-face 24 of the extinction chamber and output terminal of the circuit-breaker.

In the form of embodiment just described, the blasting is effected for a protracted time but begins only when moving contact 8' has reached its position of maximum spacing.

Reference is now made to FIGS. 4, 5 and 6 for a description of an embodiment in which the blasting begins as soon as the moving contact begins to separate from the fixed contact and in which the blasting continues beyond the instant at which the moving contact reaches its piston of maximum spacing.

In this embodiment, the blast piston 58 is once more an annular piston leaktightly slidable through the bore formed in end-face 24. Moving contact 8'' is fast with the first piston 56 which is slidable leaktightly within the blast piston. In this case, however, the said bore includes a first large-diameter section 23' adapted to receive annular piston 58, and a second smaller-diameter section 23'' adapted to receive the intermediate body 64' joining moving contact 8'' to first piston 56.

In the embodiment shown in FIGS. 4, 5 and 6, intermediate body 64' has been shown as having the same diameter as piston 56, but it is to be understood that these diameters could be different. The seal 66 provides a relative leaktightness upon passage of intermediate body 64' into bore 23'', and a rubbing contact 80 is effective in transferring the current from the moving contact to the circuit-breaker output terminal via the end-face 24 of the extinction chamber.

Intermediate body 64' is formed with a passage 82 therethrough that communicates with the axial passage 22 of the moving contact and with variable-volume blast chamber 32' (FIGS. 5 and 6).

In order to facilitate construction and assembly of the circuit-breaker, the small-diameter section 23' of the bore may be formed in a fitted part 84 instead of directly in the end-face of the extinction chamber.

The variable-volume blast chamber 32' is bounded by the upper annular surface 68 of the blast piston and by the facing fixed annular surface 86 forming part of the extinction chamber end-face 24 (or of fitted part 84, if same is used).

In the switched-in position of the circuit-breaker, shown in FIG. 4, the piston of hydraulic actuator 30' (or a rod fast therewith) exerts thrust against the undersurface of piston 56 and consequently keeps moving contact 8'' applied against fixed contact 6 against the countering pressure of the dielectric prevailing in extinction chamber 4. At the same time, actuator 30', which acts likewise on the undersurface of annular blast piston 58, maintains the latter in its uppermost position, this piston being at the same time urged downwardly by the pressure of the dielectric transmitted through passages 22 and 82 and exerted against its upper annular face 68.

In this position, the volume of blast chamber 32' is at a minimum.

To effect tripping, hydraulic actuator 30' is set to drain, its piston being thrust downwardly by the two pistons 56–58, which are themselves thrust upon by the pressure of the dielectric. During the initial phase of the tripping operation, the two pistons 56 and 58 withdraw bodily until the moving contact, having separated from the fixed contact, reaches its position of maximum spacing as determined by the stop 72 on the moving contact butting against the end of the extinction chamber (the position shown in FIG. 5). During this initial phase, the volume of chamber 32' increases, whereby the centripetal circulation of the liquid dielectric shown by the arrows 44 begins as soon as the contacts start to separate. This centripetal blast centres the arc between the contacts instead of dispersing it through the extinction chamber, as would a blast in the opposite direction.

Although the moving contact stops when it reaches its maximum spaced position, the annular piston, the permissible travel of which is greater and which continues to be thrust away by the pressure of the dielectric liquid, continues to travel downwardly whilst thrusting away actuator 30'. The volume of chamber 32' continues to increase, whereby the blasting is prolonged in the direction of arrows 44 until annular piston 58 has reached the end of its travel-set, for example, by stop means 74 (FIG. 6).

Vents 76–77 prevent the space 78 formed between the pistons from being set under negative pressure.

To cause the circuit-breaker to switch in once more, hydraulic actuator 30' is energized and, in an initial phase, causes only the blast piston 58 to rise to the position of FIG. 5. During the next phase, actuator 30' thrusts the two pistons 56 and 58 together until the moving contact returns to bear upon the fixed contact so as to close the circuit-breaker.

Throughout this operation, the volume of chamber 32' decreases and the liquid dielectric which it contained is returned into the arc extinction chamber in the opposite direction to arrows 44.

What I claim is:

1. An electric circuit-breaker for alternating currents: in which the arc extinction chamber containing the fixed and moving contacts is filled with a liquid dielectric consisting of liquefied SF6 gas under pressure; in which, when the circuit-breaker is in the switched-in position, the moving contact bears against the fixed contact solely by axial pressure exerted by thrust-exerting actuating means; and in which said moving contact has an axial passage therethrough which forms a nozzle for centripetal blasting of the liquid dielectric having port adjacent to and between the contacts; said circuit-breaker being characterized in that the moving contact is supported by a first piston which cooperates with a second coaxial or blast piston, the two said pistons sliding one within the other and the assembly formed by said coaxial pistons being slidable within a bore formed through the end-face of the arc extinction chamber; in that each of the pistons has one face in contact with the dielectric under pressure contained in the arc extinction chamber; in that said assembly is controlled by said actuating means and in that stop means limit the travel of the first piston to less than the travel of the second piston; whereby the blast process is prolonged beyond the instant at which the moving contact supported by the first piston reaches its position of maximum spacing from the fixed contact.

2. An electric circuit-breaker according to claim 1, characterized in that the first piston supporting the moving contact is an annular piston formed by a hollow cylinder sliding through said bore, in that the second piston is a solid piston slidably mounted within the first piston, said second piston bounding between one of its faces and the facing side of the moving conact a variable-volume auxiliary chamber or blast chamber communicating with the arc extinction chamber through said passage; and in that said actuating means act on said second piston.

3. An electric circuit-breaker according to claim 1, characterized in that the second piston or blast piston is an annular piston sliding within said bore; in that the first piston supporting the moving contact slides within the second piston; in that the annular surface of the second piston bounds, within said bore, a variable-volume auxiliary chamber or blast chamber communicating with the arc extinction chamber through the passage formed in the moving contact; and in that the actuating means act jointly on the two pistons.

4. A circuit-breaker according to claim 3, characterized in that said auxiliary chamber is at least partly bounded, opposite said annular surface of the second piston, by an annular surface fast with the first piston and with the moving contact.

5. A circuit-breaker according to claim 3, characterized in that said bore includes a first large-diameter section of the same diameter as the second piston, and a second smaller-diameter section, said auxiliary chamber being at least partly bounded, opposite the annular surface of the second piston, by a fixed annular surface forming part of the end-face of the arc extinction chamber through which said bore is formed.

6. A circuit-breaker according to claim 5, characterized in that said second section is of the same diameter as the first piston.

7. A circuit-breaker according to claim 1, characterized in that, when the circuit-breaker is in the switched-in position, the actuating means exert thrust upon the two-piston assembly and in that, when said actuating means are released in order to trip the circuit-breaker, the two pistons first withdraw together responsively to the pressure of the dielectric, whereupon the stop means limit the travel of the first piston whereas the second piston continues its motion alone thereby to increase the volume of the auxiliary chamber and prolong the blasting of the dielectric through the passage formed in the moving contact.

8. A circuit-breaker according to claim 1, characterized in that the liquid dielectric is maintained at a pressure higher than the critical pressure of SF6 by means of a hydro-pneumatic accumulator and in that said actuating means maintain the contacts in their closed position primarily against the elasticity of the gas contained in said accumulator.

9. A circuit-breaker according to claim 1, characterized in that the liquid dielectric is contained in the arc extinction chamber at a pressure seventimes greater than the critical pressure of SF6, and in that said actuating means maintain the contacts in the closed position solely against the volumetric elasticity of the liquid dielectric.

10. A circuit-breaker according to claim 1, characterized in that the actuating means is a hydraulic actuator the actuating rod of which exerts thrust directly on at least one of the pistons.

* * * * *